US008956199B2

(12) United States Patent
Liu

(10) Patent No.: US 8,956,199 B2
(45) Date of Patent: Feb. 17, 2015

(54) BREAST CUP ASSEMBLY AND A BRASSIERE INCORPORATING SUCH A BREAST CUP

(75) Inventor: Zhenqiang Liu, Hong Kong (HK)

(73) Assignee: Regina Miracle International (Group) Limited, Hong Kong (HK)

( * ) Notice: Subject to any disclaimer, the term of this patent is extended or adjusted under 35 U.S.C. 154(b) by 157 days.

(21) Appl. No.: 13/483,302

(22) Filed: May 30, 2012

(65) Prior Publication Data

US 2013/0165017 A1 Jun. 27, 2013

(30) Foreign Application Priority Data

Dec. 23, 2011 (CN) ..... 2011 1 0447577

(51) Int. Cl.
*A41C 3/00* (2006.01)

(52) U.S. Cl.
USPC ..... 450/38; 450/54

(58) Field of Classification Search
USPC ..... 450/38, 37, 54–57
See application file for complete search history.

(56) References Cited

U.S. PATENT DOCUMENTS

| | | | | |
|---|---|---|---|---|
| 6,857,932 | B2 * | 2/2005 | Chen | 450/38 |
| 7,252,574 | B2 * | 8/2007 | Chen | 450/38 |
| 7,618,304 | B2 * | 11/2009 | Chen | 450/38 |
| 2006/0160468 | A1 * | 7/2006 | Chen | 450/57 |
| 2008/0096464 | A1 | 4/2008 | Falla | 450/38 |
| 2010/0273395 | A1 | 10/2010 | Castellano | 450/39 |
| 2011/0136406 | A1 * | 6/2011 | Finocchiaro | 450/58 |
| 2012/0129427 | A1 | 5/2012 | Perez | 450/36 |

FOREIGN PATENT DOCUMENTS

| | | | |
|---|---|---|---|
| CN | 1241380 | | 1/2000 |
| CN | 2465493 | Y | 12/2001 |
| CN | 2756021 | | 2/2006 |
| CN | 200983848 | Y | 12/2007 |
| CN | 201097628 | Y | 8/2008 |
| CN | 101267751 | | 9/2008 |
| CN | 201312558 | Y | 9/2009 |
| CN | 201349529 | Y | 11/2009 |
| CN | 101972044 | A | 2/2011 |
| CN | 201767059 | | 3/2011 |
| CN | 102125313 | | 7/2011 |
| CN | 103169161 | A | 6/2013 |

OTHER PUBLICATIONS

Office Action and Search Report dated Sep. 23 2014 issued in corresponding Chinese Patent Application No. 201210324169.3 with English translation.

*Primary Examiner* — Gloria Hale
(74) *Attorney, Agent, or Firm* — Ostrolenk Faber LLP

(57) ABSTRACT

There is provided a breast cup assembly comprising an outer panel comprising an outer fabric layer, an inner panel comprising an inner fabric layer, an inner flexible film applied over the convex surface of the inner panel, an outer flexible film applied to the inner flexible film such that the inner and outer flexible films are sealed substantially proximal to a periphery of the inner panel forming a cavity between the inner and outer flexible films, and a gel pad positioned in the cavity formed between the inner and outer flexible films. A method of producing such a breast cup assembly is also provided.

22 Claims, 6 Drawing Sheets

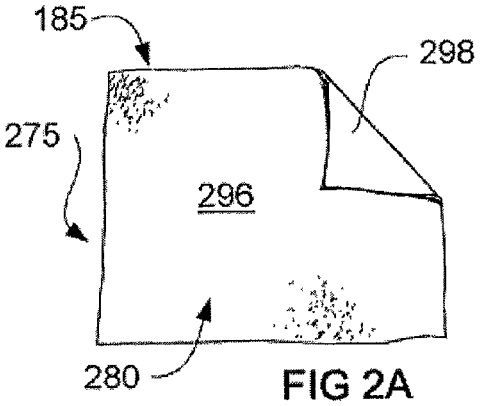
FIG 2A
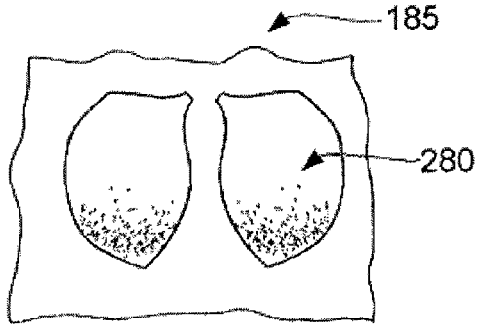
FIG 2B
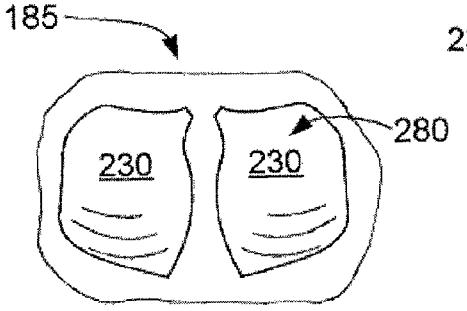
FIG 2C
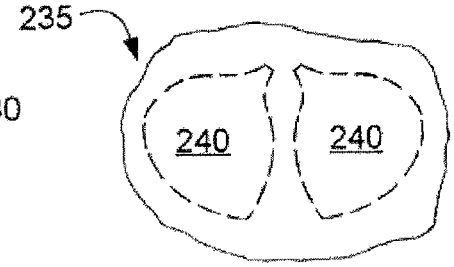
FIG 2D
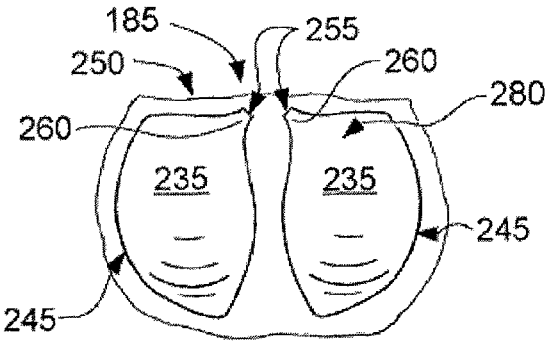
FIG 2E
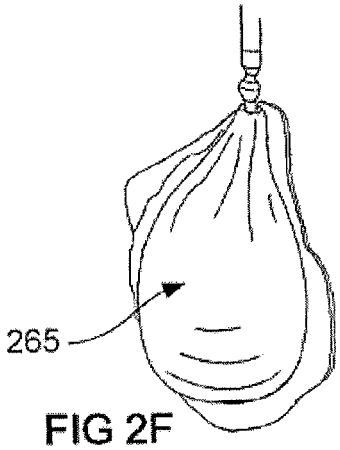
FIG 2F
FIG 2G
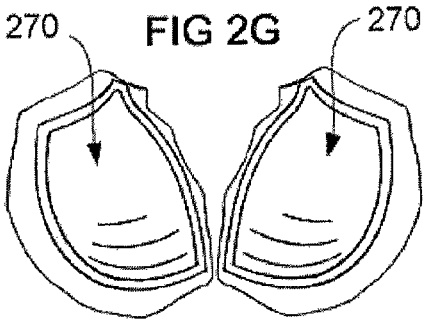
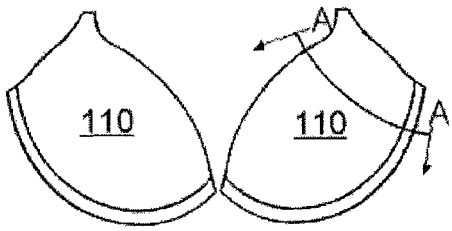
FIG 2H

BREAST CUP ASSEMBLY AND A BRASSIERE INCORPORATING SUCH A BREAST CUP

FIELD OF THE INVENTION

The present invention relates generally to brassieres and in particular to a breast cup assembly, a method of manufacturing a breast cup and a brassiere incorporating two such breast cups. The present invention also relates to a molded breast cup incorporated with other components to define a brassiere or other garment of clothing.

BACKGROUND TO THE INVENTION

A conventional brassiere comprises of a pair of breast cups intended to cover and support the breasts of the wearer, a connector securing together the inner edges of the cups at the wearer's cleavage, and at least one strap-like back wing that extends from outer edges of the breast cups around the back of the wearer. The brassiere may further include shoulder straps that extend from upper edges of the breast cups over the shoulders of the wearer to attachment points on the strap-like back wing crossing the wearer's back.

It is also standard to use an underwire to shape and support the lower periphery of each breast cup. An underwire typically consists of a U-shaped frame formed from metal or a rigid plastic material. Usually a pair of underwires is incorporated into a brassiere or other undergarment to provide shape and support for a pair of breast cups.

The function of the brassiere is to generally provide support for the wearer's bust in a manner that is comfortable to the wearer. However, it is becoming increasingly desirable for the brassiere to enhance the appearance of the wearer's bust while maintaining a natural look and feel.

The appearance of the wearer's bust can be enhanced by including pads, sometimes referred to as "cookies", in the breast cup to create the illusion of a larger breast size. The "cookies" are generally formed from a foam material and are positioned within the lower portion of the breast cup to provide support to the breast and enhance the shape of the brassiere.

While the use of pads does enhance the apparent size of the wearer's breasts, certain disadvantages have resulted from their use. These disadvantages relate to the way the bra feels to touch and the appearance the bra makes under the wearer's clothes. This has resulted in a less than natural look and feel.

In light of the foregoing, it would be desirable to provide a brassiere that enhances the appearance of the wearer's bust while maintaining a natural look or feel.

SUMMARY OF THE INVENTION

According to an aspect of the present invention, there is provided a breast cup assembly comprising:

(a) an outer panel comprising an outer fabric layer;

(b) an inner panel comprising an inner fabric layer, the inner panel having a concave surface and a convex surface;

(c) an inner flexible film applied over the convex surface of the inner panel;

(d) an outer flexible film applied to the inner flexible film, or more precisely, to the outer side of the inner flexible film, such that the inner and outer flexible films are sealed substantially proximal to a periphery of the inner panel forming a cavity between the inner and outer flexible films; and (e) a gel pad positioned in the cavity formed between the inner and outer flexible films.

The inner panel is the panel that is more proximate to a wearer's body than the outer panel. The concave surface of the inner panel is more proximate to a wearer's body than the convex surface of the inner panel. The inner flexible film is more proximate to the wearer's body than the outer flexible film.

Except otherwise specified, for example where the inner region or the inner edge of a breast cup is referred to (in which case "inner" indicates a position more proximate the cleavage than "outer") or where the outer region or the outer edge of a breast cup is referred to (in which case "outer" indicates a position more distal the cleavage than "inner"), the word "outer" as used here and hereinbelow is used to indicate that the element to which it refers, relative to another corresponding element which is referred to as "inner", is more distal a wearer of the garment such as a brassiere when the garment is worn; similarly, the word "inner" as used here and hereinbelow is used to indicate that the element to which it refers, relative to another corresponding element which is referred to as "outer", is more proximal a wearer of the garment when the garment is worn.

The inner panel preferably includes an inner foam layer. However, it may be single-layered or multi-layered. Alternatively, the outer panel may include an outer foam layer. But, again, it may be single-layered or multi-layered.

In another embodiment, the inner panel includes an inner foam layer and the outer panel also includes an outer foam layer such that the gel pad is located between the inner and outer foam layers.

The gel pad may comprise a polyurethane gel such as a two part polyurethane elastomer. Such gels provide the advantage that they can be cured substantially 100% to a solid state. Moreover, such gels provide the desired natural feel in the cured state.

The inner and outer flexible films may comprise a thermoplastic polyurethane film.

According to an embodiment, the gel pad overlies substantially an entire surface area of the inner panel.

According to another aspect of the present invention, there is provided a brassiere comprising:

(a) two breast cups, each breast cup comprising:

(i) an outer panel comprising an outer fabric layer;

(ii) an inner panel comprising an inner fabric layer, the inner panel having a concave surface and a convex surface;

(iii) an inner flexible film applied over the convex surface of the inner panel;

(iv) an outer flexible film applied to the inner flexible film, or more precisely to the outer side of the inner flexible film, such that the inner and outer flexible films are sealed substantially proximal to a periphery of the inner panel forming a cavity between the inner and outer flexible films; and (v) a gel pad positioned in the cavity formed between the inner and outer flexible films;

(b) a connector extending between an inner region of the two breast cups; and (c) a back strap extending from an outer region of one of the two breast cups to an outer region of the other of the two breast cups to secure the brassiere to a torso of the wearer.

The concave surface of the inner panel is the surface that is more proximate to the wearer's body than the convex surface of the inner panel.

According to yet another aspect of the present invention, there is provided a method of manufacturing a breast cup assembly, the method comprising the following steps:

(a) providing an outer panel including an outer fabric layer;

(b) providing an inner panel including an inner fabric layer;

(c) molding the inner panel to a cup form such that the inner panel includes a convex surface on the outer side of the inner panel and a concave surface on the inner side of the inner panel;

(d) applying an inner flexible film over the convex surface of the inner panel;

(e) applying an outer flexible film to the inner flexible film, or more precisely to the outer side of the inner flexible film, and sealing the inner and outer flexible films proximal to a periphery of the inner panel while maintaining an opening between the inner flexible film and the outer flexible film at a predetermined location;

(f) inserting a gel through the opening between the inner flexible film and the outer flexible film to form a gel pad;

(g) sealing the opening between the inner flexible film and the outer flexible film;

(h) curing the gel so as to maintain the cup form of the inner panel;

(i) attaching the outer panel to the inner panel and gel pad to form the breast cup assembly; and (j) trimming the breast cup assembly to the desired shape.

The inner flexible film may be applied to the convex surface of the inner panel by suction or vacuum forming means. Furthermore, the step of applying an inner flexible film to the convex surface of the inner panel may be preceded by the step of applying an adhesive to the convex surface of the inner panel to secure adhesion of the inner flexible film to the inner panel.

In one form of the invention, the inner flexible film is heated prior to application of the inner flexible film to the convex surface of the inner panel by suction or vacuum forming means.

The outer flexible film may be formed into a cup shape prior to application to the inner flexible film. Preferably, the outer flexible film is preformed into a cup shape by suction or vacuum forming means. The outer flexible film may be heated prior to preforming into a cup shape by suction or vacuum forming means.

The step of sealing the inner and outer flexible films proximal to a periphery of the inner panel may include sealing by high frequency welding or by heat sealing.

According to an embodiment, the step of inserting a gel through the opening between the inner flexible film and the outer flexible film to form a gel pad includes injecting the gel through the opening.

Alternatively, the step of inserting a gel through the opening between the inner flexible film and the outer flexible film to form a gel pad includes pouring the gel through the opening.

The step of curing the gel to maintain the cup form of the inner panel may include placing the inner panel and gel pad between opposing molds and applying heat thereto.

According to still another aspect of the present invention, there is provided a method of manufacturing a breast cup assembly, the method comprising the following steps:

(a) providing an inner panel including an inner fabric layer;

(b) providing an outer panel including an outer fabric layer;

(c) molding the outer panel to a cup form such that the outer panel includes a concave surface on the inner side of the outer panel and a convex surface on the outer side of the outer panel;

(d) applying an outer flexible film to the concave surface of the outer panel;

(e) applying an inner flexible film to the outer flexible film, or more precisely to the inner side of the outer flexible film, and sealing the inner and outer flexible films proximal to a periphery of the outer panel while maintaining an opening between the inner flexible film and the outer flexible film at a predetermined location;

(f) inserting a gel through the opening between the inner flexible film and the outer flexible film to form a gel pad;

(g) sealing the opening between the inner flexible film and the outer flexible film;

(h) curing the gel so as to maintain the cup form of the outer panel;

(i) attaching the inner panel to the outer panel and gel pad to form the breast cup assembly; and (j) trimming the breast cup assembly to the desired shape.

The outer flexible film may be applied to the concave surface of the outer panel by suction or vacuum forming means. Furthermore, the step of applying an outer flexible film to the concave surface of the outer panel may be preceded by the step of applying an adhesive to the concave surface of the outer panel to secure adhesion of the outer flexible film to the outer panel.

In one form of the invention, the outer flexible film is heated prior to application of the outer flexible film to the concave surface of the outer panel by suction or vacuum forming means.

The inner flexible film may be formed into a cup shape prior to application to or affixing it to the outer flexible film. Preferably, the inner flexible film is preformed into a cup shape by suction or vacuum forming means. The inner flexible film may be heated prior to preforming into a cup shape by suction or vacuum forming means.

The step of sealing the inner and outer flexible films proximal to a periphery of the outer panel may include sealing by high frequency welding or by heat sealing.

According to an embodiment, the step of inserting a gel through the opening between the inner flexible film and the outer flexible film to form a gel pad includes injecting the gel through the opening.

Alternatively, the step of inserting a gel through the opening between the inner flexible film and the outer flexible film to form a gel pad includes pouring the gel through the opening.

The step of curing the gel to maintain the cup form of the outer panel may include placing the outer panel and gel pad between opposing molds and applying heat thereto.

According to still another aspect of the present invention, there is provided a method of manufacturing a breast cup assembly, the method comprising the following steps:

(a) providing a first panel including a fabric layer;

(b) providing a second panel including a fabric layer;

(c) molding the first panel to a cup form such that the first panel includes a concave surface on one side of the first panel and a convex surface on the opposite side of the first panel;

(d) applying a first flexible film over a surface of the first panel, the surface being the one that is going to face the second panel in the breast cup assembly to be formed;

(e) applying a second flexible film to the first flexible film and sealing the first and second flexible films proximal to a periphery of the first panel while maintaining an opening between the first flexible film and the second flexible film at a predetermined location;

(f) inserting a gel through the opening between the first flexible film and the second flexible film to form a gel pad;

(g) sealing the opening between the first flexible film and the second flexible film;

(h) attaching the second panel to the first panel and gel pad to form the breast cup assembly; and (i) trimming the breast cup assembly to the desired shape.

The step of applying a second flexible film to the first flexible film includes applying the second flexible film to the first flexible film over a surface of the first flexible film that is opposite the surface of the first flexible film facing the first panel.

The first flexible film may be applied to the first panel by suction or vacuum forming means. Furthermore, the step of applying a first flexible film to the first panel may be preceded by the step of applying an adhesive to the surface of the first panel that is to face the first flexible film to secure adhesion of the first flexible film to the first panel.

In one form of the invention, the first flexible film is heated prior to application of the first flexible film to the first panel by suction or vacuum forming means.

The second flexible film may be formed into a cup shape prior to application to or affixing it to the first flexible film. Preferably, the second flexible film is preformed into a cup shape by suction or vacuum forming means. The second flexible film may be heated prior to preforming into a cup shape by suction or vacuum forming means.

The step of sealing the first and second flexible films proximal to a periphery of the first panel may include sealing by high frequency welding or by heat sealing.

According to an embodiment, the step of inserting a gel through the opening between the first flexible film and the second flexible film to form a gel pad includes injecting the gel through the opening.

Alternatively, the step of inserting a gel through the opening between the first flexible film and the second flexible film to form a gel pad includes pouring the gel through the opening.

The step of attaching the second panel to the first panel and gel pad to form the breast cup assembly may be preceded by the step of curing the gel so as to maintain the cup form of the first panel. The step of curing the gel to maintain the cup form of the first panel may include placing the first panel and gel pad between opposing molds and applying heat thereto.

BRIEF DESCRIPTION OF THE DRAWINGS

It will be convenient to hereinafter describe the invention in greater detail by reference to the accompanying drawings which show two preferred embodiments of the invention, and to facilitate understanding of the method according to this invention. The particularity of the figures and the related description is not intended to supersede the generality of the broad definition of the invention as given in the attached claims.

FIG. 2A is a top down view of a precursor sheet which is to form an inner panel of the breast cup assembly in accordance with an embodiment of the present invention.

FIG. 2B is a top down view of the precursor sheet of FIG. 2A molded into two cup forms.

FIG. 2C is a top down view of the precursor sheet of FIG. 2B with an inner flexible film applied over the convex surface of the precursor sheet.

FIG. 2D is a top down view of an outer flexible film with cup forms formed.

FIG. 2E is a top down view of the precursor sheet of FIG. 2C with the inner and outer flexible films sealed about their periphery in accordance with an embodiment of the present invention.

FIG. 2F is shows a liquid state gel-like substance being injected or poured into a cavity formed between the inner and outer flexible films via an opening in accordance with an embodiment of the present invention.

FIG. 2G is a top down view showing two inner panels each with a cured gel pad positioned between the first and second flexible films in accordance with an embodiment of the present invention.

FIG. 2H is a top down view of a pair of trimmed breast cups in accordance with an embodiment of the present invention.

DETAILED DESCRIPTION

Figure 1:
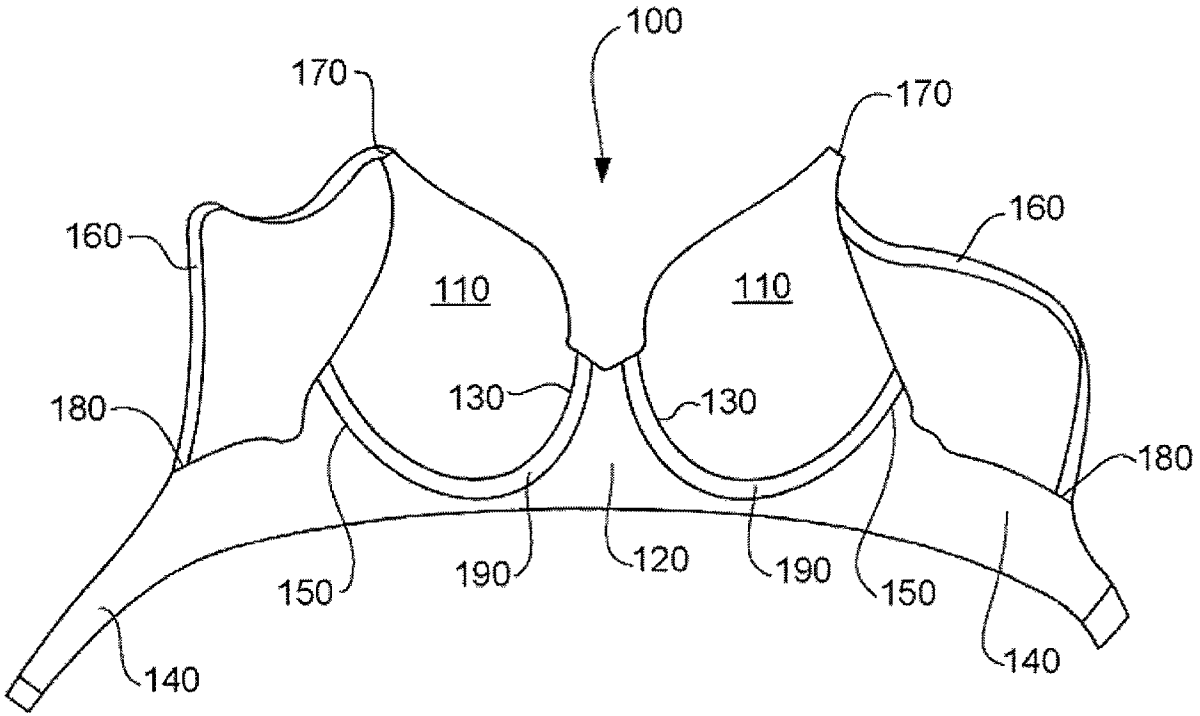
FIG 1 (PRIOR ART)
FIG. 1 is a front view of a conventional brassiere.

Referring firstly to FIG. 1, there is shown a typical brassiere 100 comprising of a pair of breast cups 110 intended to cover and support the breasts of the wearer, a connector 120 securing together the inner edges 130 of the cups at the wearer's cleavage, and at least one strap-like back wing or panel 140 that extends from the outer edges 150 of the breast cups around the back of the wearer. The brassiere 100 may further include shoulder straps 160 that extend from upper edges 170 of the breast cups 110 over the shoulders of the wearer to attachment points 180 on the back wing or wings 140 crossing the wearer's back.

The brassiere 100 further includes a pair of substantially U-shaped under wires to shape and support the lower periphery of each breast cup 110. An underwire typically consists of a U-shaped frame formed from metal or a rigid plastic material. In this case the brassiere includes a pair of underwires positioned about the lower periphery 190 of each breast cup 110.

Figure 4C:
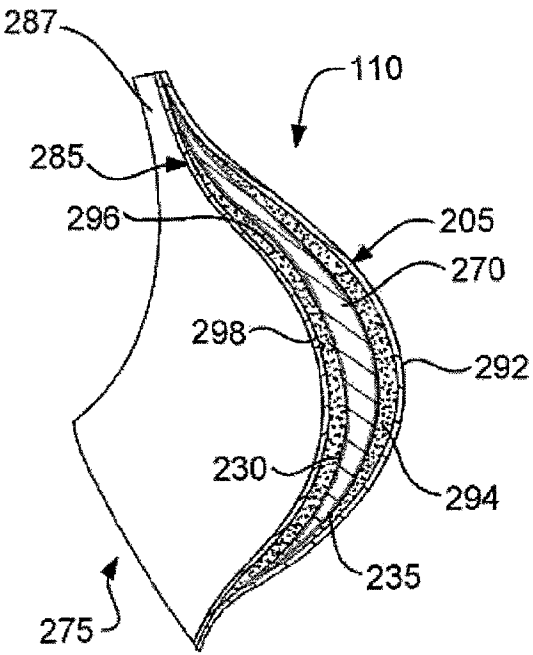
FIG. 4C is an isometric sectional view of the breast cup of FIG. 2H taken at the sectional plane and in the direction indicated by section lines A-A according to yet another embodiment of the present invention.
Figure 4B:
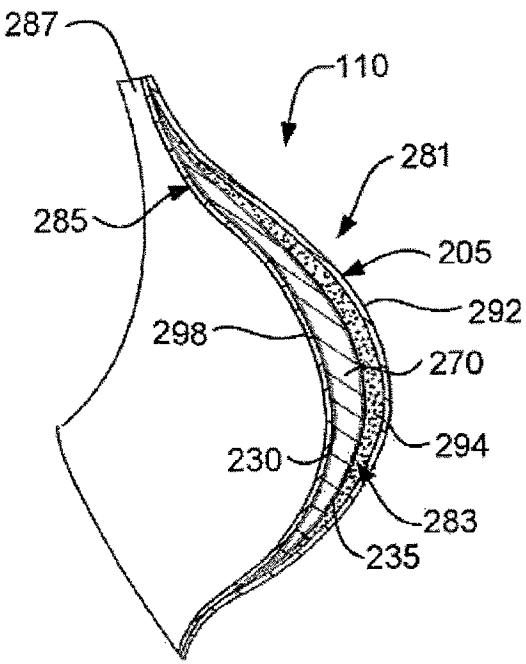
FIG. 4B is an isometric sectional view of the breast cup of FIG. 2H taken at the sectional plane and in the direction indicated by section lines A-A according to another embodiment of the present invention.
Figure 4A:
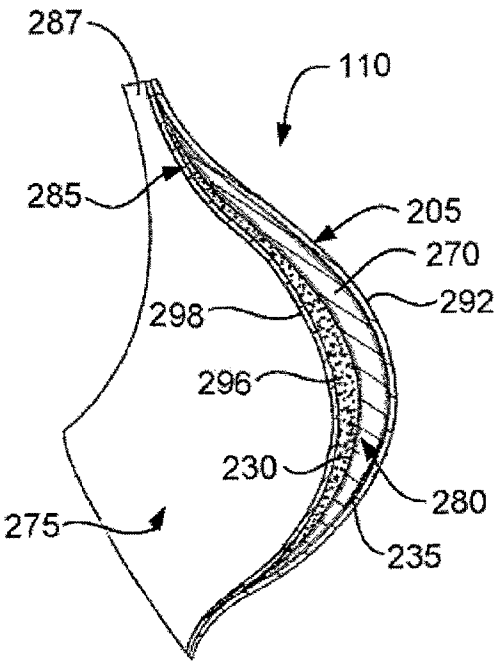
FIG. 4A is an isometric sectional view of the breast cup of FIG. 2H taken at the sectional plane and in the direction indicated by section lines A-A according to one embodiment of the present invention.

Referring now to FIG. 4A, in accordance with a preferred embodiment of the present invention, each breast cup 110 comprises an outer panel 205 having an outer fabric layer 292 and an inner panel 285 having an inner fabric layer 298. The inner panel 285 has a concave surface 275 and a convex surface 280. The concave surface 275 contacts a wearer's skin or is, relative to the convex surface 280, more proximal the wearer's skin. The convex surface 280 does not contact or is, relative to the concave surface 275, more distal the wearer's skin.

In the embodiment as shown in FIG. 4A, the inner panel 285 comprises an inner fabric layer 298 laminated with an inner foam layer 296. As illustrated, the inner foam layer 296 is laminated to the convex surface of the inner fabric layer 298. Hence, in this embodiment, as is apparent from FIG. 4A, the convex surface of the inner foam layer 296 is the convex surface 280 of the inner panel 285.

An inner flexible film 230, which preferably is of substantially the same size as that of the inner panel 285, is applied to the convex surface 280 of the inner panel 285, and overlies and is affixed to all of or substantially the convex surface 280 of the inner panel 285. As will be described in more detail later on, the application of the inner flexible film 230 to the convex surface 280 of the inner panel 285 is preferably by suction or vacuum forming means, preferably preceded by the spraying of adhesives on the convex surface 280 of the inner panel 285. The material selected for the inner flexible film 230 should be such that it will attach well to the convex surface 280 of the inner panel 285 upon suction preferably with the application of adhesives between the film 230 and the inner panel 285. Where the convex surface 280 of the inner panel 285 is the convex surface of a layer of polyurethane foam, as in the case where the inner panel 285 comprises an inner fabric layer and an inner layer of polyurethane foam laminated to the inner fabric layer, a preferred and suitable material for the inner flexible film 230 is thermoplastic polyurethane film.

An outer flexible film 235, which is preferably of substantially the same size as that of, and preferably of the same material as that of, the inner flexible film 230, is applied to the outer side of the inner flexible film. The application is such that the inner flexible film 230 and the outer flexible film 235 are sealed around their edges, for example by high frequency welding or by heat sealing, preferably substantially proximal to a periphery of the inner panel 285. This sealing of the edges of the inner and outer flexible films 230, 235 forms a cavity between the films 230, 235. This cavity is adapted to receive a gel pad 270.

The gel pad 270 is formed from a gel-like substance, such as for example silicone gel, or more preferably polyurethane gel. Polyurethane gel is preferred because experiments have shown that where the inner panel 285 comprises an inner layer of polyurethane foam, the curing of the polyurethane gel will more easily and effectively be accomplished than if silicone gel or other gel substance is used. The polyurethane gel is preferably initially provided in liquid state to enable the gel to be injected or otherwise poured into the cavity formed between the inner flexible film 230 and the outer flexible film 235, before the gel is being subjected to curing.

An example of a suitable polyurethane gel is a two part polyurethane elastomer. Two part polyurethane elastomers are synthesised from two components, component A and component B. Component A has polyol as a major chemical base and component B has diphenylmethane-4,4-diisocyanate (MDI) as a base. Components A and B crosslink at room temperature via a polyaddition reaction. The polymerisation can be accelerated by heat or by use of a catalyst.

Figure 3:
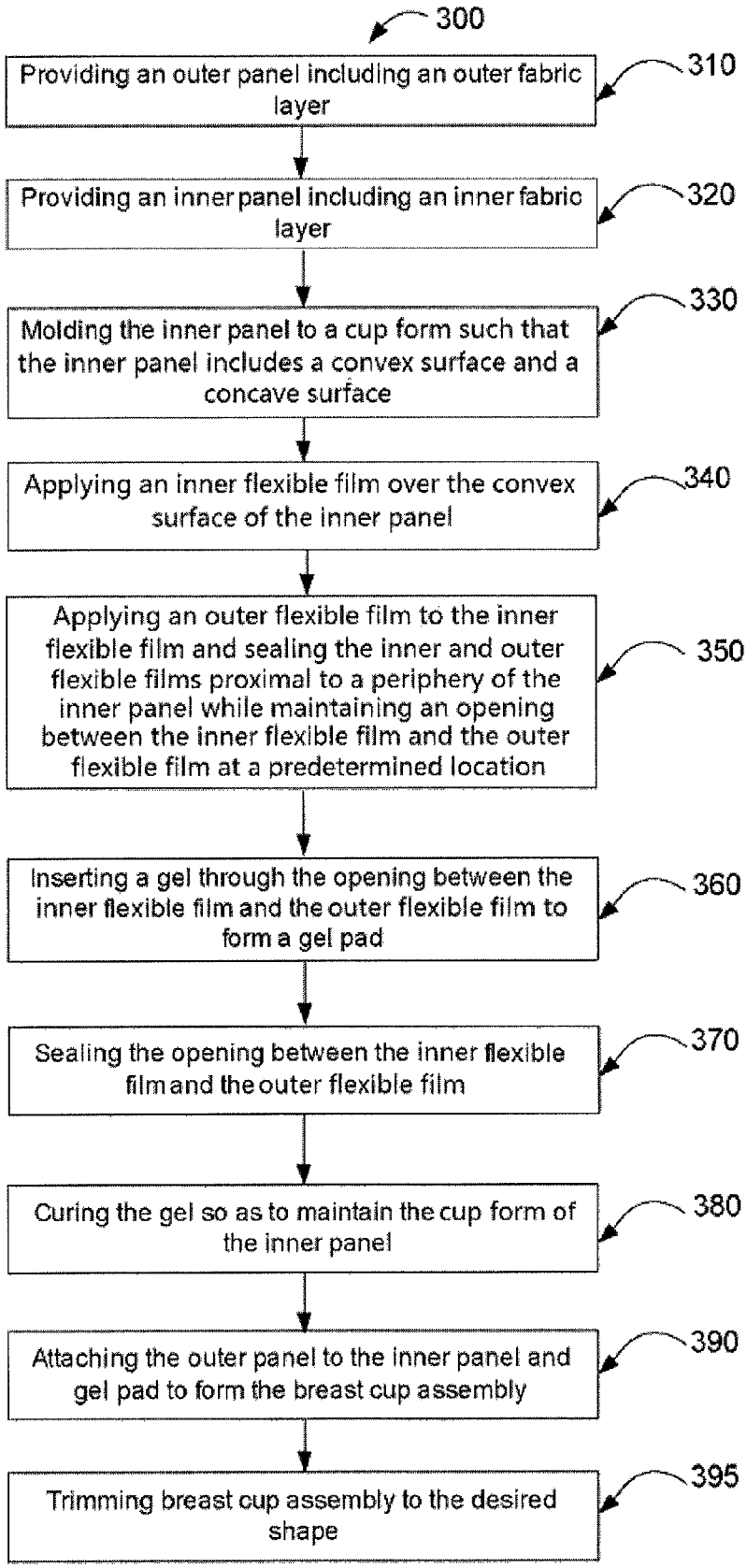
FIG. 3 is a flow chart showing the steps of the method of manufacturing a breast cup assembly in accordance with an embodiment of the present invention.

Referring to FIGS. 2A to 2H in conjunction with the flowchart of FIG. 3, there is now described a preferred method for forming a breast cup assembly in accordance with the present invention. First, at step 310, there is provided an outer panel 205 including an outer fabric layer 292. Then, an inner panel 285 including an inner fabric layer 298 preferably laminated with an inner foam layer 296 is provided at step 320. Referring to FIG. 2A, there is shown a precursor sheet which is to form an inner panel 285 of the breast cup assembly in accordance with the invention. The precursor sheet 185 comprises an inner fabric layer 298 laminated with an inner foam layer 296. Various types of foam may be suitable, but polyurethane foam is preferred. In the precursor sheet 185, the open surface of the foam layer, i.e., the surface opposite the surface that faces the fabric layer, will form the convex surface 280 of the inner panel 285. The open surface of the fabric layer, i.e., the surface opposite the surface that faces the foam layer, will form the concave surface 275 of the inner panel 285.

Next, at step 330, the inner panel is molded into a cup form to approximate the curvature of a wearer's breast. The molding is for example accomplished by placing the inner panel between two complementary mold portions of a molding device and molding it for example at a temperature of 180° C. to 200° C. for a period of 120 seconds. FIG. 2B shows the precursor sheet 185 which has been subjected to molding to give rise to two cup forms, each corresponding to a breast cup of the brassiere to be formed. Each such cup form has a concave surface which corresponds to the concave surface 275 of the inner panel 285 of the breast cup 110 and a convex surface which corresponds to the convex surface 280 of the inner panel 285 of the breast cup 110. The next step 340 involves applying an inner flexible film 230 to the open surface of the foam layer of the precursor sheet which is to form the inner panel 285, and this step in effect applies the inner flexible film 230 to the convex surface of the inner panel 285. The film 230 needs to be flexible and impermeable to the gel-like substance used to form the gel pad. For instance, one example of a suitable flexible film is a thermoplastic polyurethane film. A thermoplastic polyurethane film also has the advantage that it adheres well to polyurethane foam if the latter is used to form the foam layer on the convex side of the inner panel 285. The inner flexible film 230 is preferably applied to the convex surface 280 of the inner panel 205 using suction, or vacuum forming means. Preferably, the application of the inner flexible film 230 to the convex surface 280 of the inner panel 285 is preceded by the step of applying, for example by spraying, an adhesive to the convex surface of the inner panel to ensure secure adhesion of the inner flexible film 230 to the inner panel 285. Prior to the application of the film by suction or vacuum forming, the inner flexible film 230 is preferably heated to soften the film and enhance its flexibility and ability to be shaped to conform to the shape of the cup form after the suction or vacuum forming process.

At step 350, an outer flexible film 235 is applied over the inner flexible film 230. Shown in FIG. 2D is the outer flexible film. Preferably, before applying the outer flexible film 235 over the inner flexible film 230 to form a cavity therebetween, the outer flexible film 235 is subjected to a suction or vacuum forming process so as to enable it to have cup shape 240 formed on it to conform to or approximate the cup form shape of the preformed inner panel 285. Again, the outer flexible film 235 is preferably pre-heated to soften the film and enhance its flexibility and ability to be shaped to conform to the shape of the cup form.

With reference to FIG. 2E, there is shown an outer flexible film 235 having been applied over the inner flexible film (not shown), the latter being adhered to the precursor sheet 185 that is to form the inner panel 285. The two flexible films 230, 235 are sealed around their periphery 245, i.e. substantially proximal to a periphery 250 of the cup form corresponding to the inner panel. In such sealing, it is preferably ensured that an opening 255 is maintained between the inner flexible film 230 and the outer flexible film 235 at a predetermined location 260, for example around a region where a shoulder strap would be attached to the breast cup. Preferably, the periphery 245 of the flexible films 230, 235 is sealed using a high frequency welding technique, or by heat sealing. Once sealed, as shown in FIG. 2F, the flexible films 230, 235 form a cavity 265 into which a liquid state gel-like substance can, at step 360, be injected or poured via the opening 255 in order to form the gel pad 270.

Once the gel-like substance has been injected into the cavity 265 formed between the inner and outer flexible films 230, 235, the opening 255 is sealed, at step 370, to prevent leakage of the gel-like substance therefrom. The opening 255 is sealed preferably also using a high frequency welding technique or by heat sealing. The gel-like substance is then cured, at step 380, preferably between the two complementary mold portions that molded the inner panel 285 in order to maintain the desired cup form of the breast cup 110. The gel-like substance may be cured, for example, at a temperature of 70 to 80 degrees Celsius for a period of 5 to 6 minutes.

FIG. 2G shows the gel has been cured to a substantially solid state. The outer panel 205 may then be attached to the inner panel and gel pad assembly, which comprises the inner panel 285 and the gel pad 270 captured between the inner and outer flexible films 230, 235, either at step 390 before trimming the breast cup to shape, to save re-trimming, or after step 390. The attachment of the outer panel 205 may involve, for example, stitching the outer panel to the inner panel and gel pad assembly along the periphery, or joining the outer panel to the inner panel and gel pad assembly along the periphery by non-stitching means such as ultrasonic welding, or folding at least part of the outer panel's edge over to the concave side of the inner panel and gel pad assembly and affixing the folded-over edge to the concave side of the inner panel by, for example, adhesive tape. At step 395, the assembly so formed is trimmed to shape to form a breast cup assembly in accordance with the invention, as shown in FIG. 2H. The other components comprising a brassiere may then be attached to produce a finished brassiere.

Figure 5:
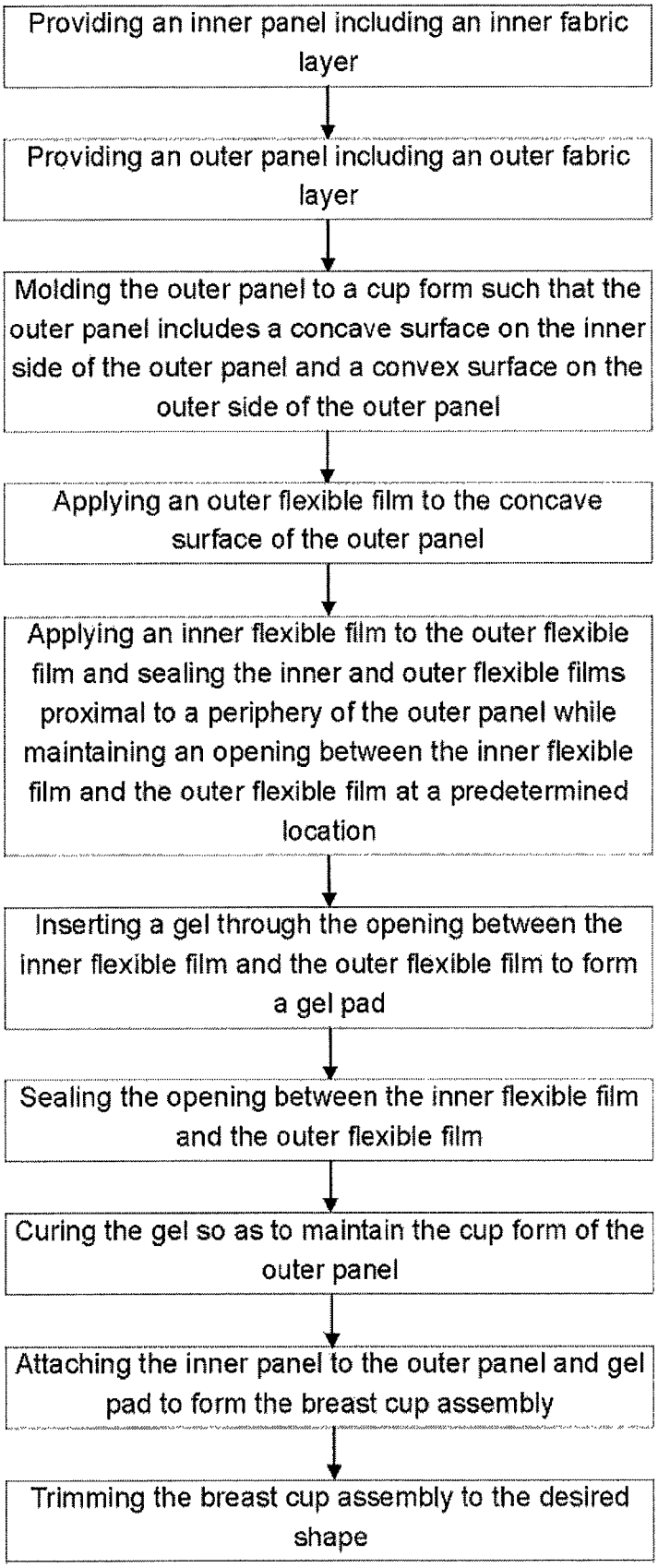
FIG. 5 is a flow chart showing the steps of the method of manufacturing a breast cup assembly in accordance with another embodiment of the present invention.

In an alternative embodiment, the breast cup assembly in accordance with the invention has the gel pad assembly comprising the gel pad 270 captured between the inner flexible film 230 and the outer flexible film 235 first applied over the inner or concave surface 283 of the outer panel 205 before the inner panel 285 is being attached to the outer panel and gel pad assembly. The gel pad 270 is still formed in the same way between inner flexible film 230 and an outer flexible film 235. In this embodiment, while the outer panel 205 preferably includes an outer fabric layer 292 with an outer foam layer 294 laminated thereto, inner panel 285 may comprise an inner fabric layer 298 with or without an inner foam layer laminated thereto. FIG. 4B illustrates one example of this embodiment where the inner fabric layer 298 does not have an inner foam layer laminated to it. FIG. 5 is a flowchart showing a preferred method for forming a breast cup assembly in accordance with this embodiment.

Figure 6:
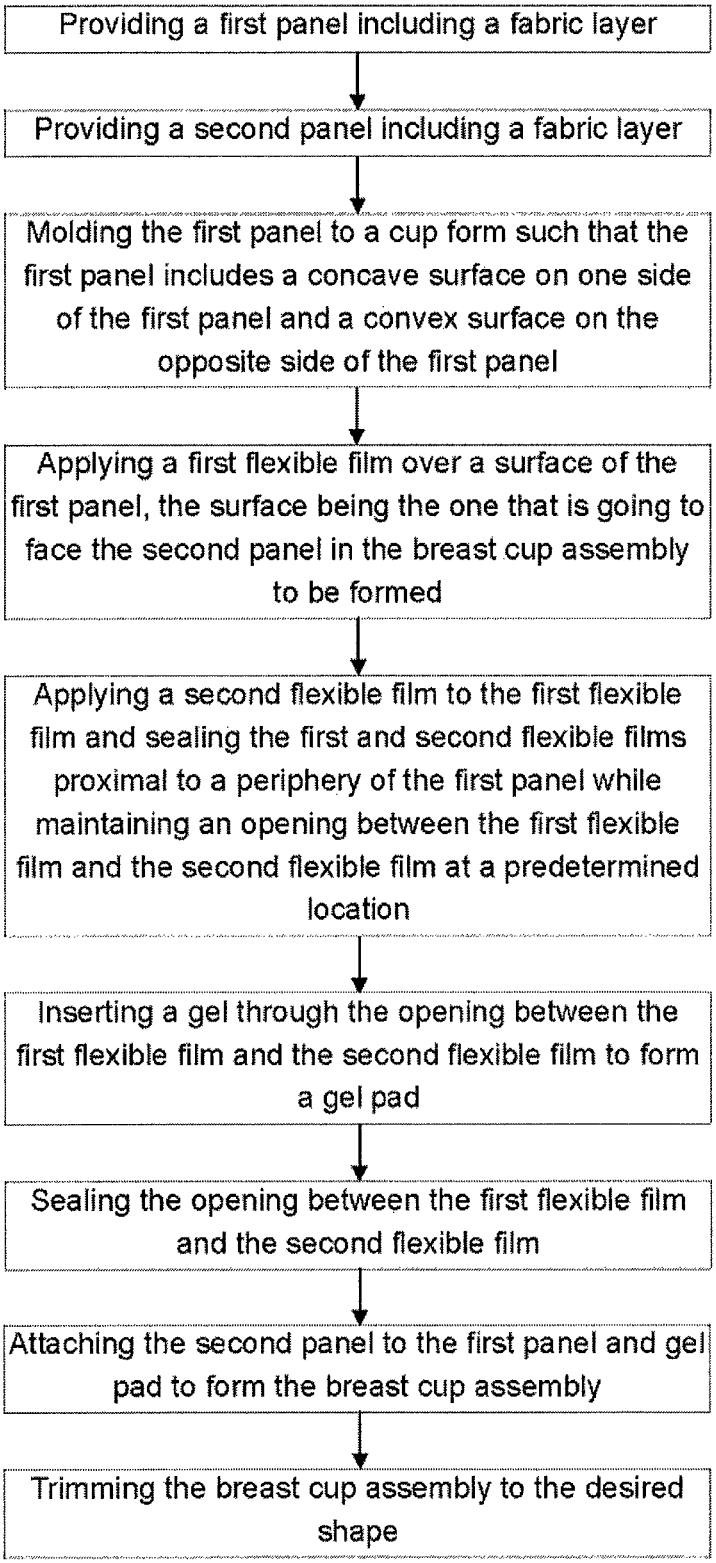
FIG. 6 is a flow chart showing the steps of the method of manufacturing a breast cup assembly in accordance with yet another embodiment of the present invention.

FIG. 4C shows yet another embodiment, in which each of the outer panel 205 and the inner panel 285 comprises a fabric layer with a foam layer laminated thereto. In this embodiment, the additional layer of foam may reduce the desirous natural feel provided by the gel pad in the embodiments described with reference to FIGS. 4A and 4B. For this embodiment, the gel pad assembly comprising the gel pad 270 between the inner flexible film 230 and the outer flexible film 235 may either be first applied over the convex surface of the inner panel or be first applied over the concave surface of the outer panel. This is followed by attaching the outer panel or the inner panel, as the case may be, to the inner or the outer panel respectively and the gel pad assembly to form the breast cup assembly. FIG. 6 is a flowchart showing a preferred method for forming a breast cup assembly in accordance with this embodiment.

It is an advantage of the present invention that since the high frequency sealing of the first flexible film and the second flexible film to form the cavity for receiving the gel pad forms a discrete and thin seal, it is possible for the gel pad itself to overlay much of the inner or outer panel, providing an enhanced look, comfort and feel substantially over the entire breast cup. Examples have shown that it is possible for the gel pad to overlay not less than 99% of the area of the breast cup's inner or outer panel thereby providing optimal look, comfort and feel.

Furthermore, it is an advantage of the present invention that the breast cup of the present invention has a structure which enhances the appearance of and may enhance the apparent size of a wearer's breasts whilst maintaining a natural look and feel.

It will be appreciated by a person skilled in the art that while reference herein is being made to a brassiere which incorporates the breast cup assembly of the present invention, the breast cup assembly may alternatively be incorporated into garments of a different kind, such as for example swimsuits, evening dresses or the like.

While the invention has been described in conjunction with a limited number of embodiments, it will be appreciated that many alternative modifications and variations in light of the foregoing description are possible. Accordingly, the present invention is intended to embrace all such alternative modifications and variations as may fall within the spirit and scope of the invention as disclosed in the attached claims.

The invention claimed is:

1. A breast cup assembly comprising:

(a) an outer panel comprising an outer fabric layer and an outer panel periphery;

(b) an inner panel comprising an inner fabric layer, the inner panel having a concave surface and a convex surface;

(c) an inner flexible film applied over the convex surface of the inner panel;

(d) an outer flexible film applied to the inner flexible film such that the inner and outer flexible films are sealed substantially proximal to a periphery of the inner panel forming a cavity between the inner and outer flexible films; and (e) a gel pad positioned in the cavity formed between the inner and outer flexible films, wherein the outer panel is attached only at the outer panel periphery to the inner panel by stitching, by welding, or by glue.

2. A breast cup assembly according to claim 1, wherein the inner panel further includes an inner foam layer and the outer panel does not include a foam layer.

3. A breast cup assembly according to claim 1, wherein the outer panel further includes an outer foam layer and the inner panel does not include a foam layer.

4. A breast cup assembly according to claim 1, wherein the inner panel further includes an inner foam layer and the outer panel further includes an outer foam layer such that the gel pad is located between the inner and outer foam layers.

5. A breast cup assembly according to claim 1, wherein the gel pad comprises a polyurethane gel.

6. A breast cup assembly according to claim 1, wherein the inner and outer flexible films comprise a thermoplastic polyurethane film.

7. A breast cup assembly according to claim 1, wherein the gel pad overlies substantially an entire surface area of the inner panel.

8. A brassiere comprising:

(a) two breast cups, each breast cup comprising:

(i) an outer panel comprising an outer fabric layer and an outer panel periphery;

(ii) an inner panel comprising an inner fabric layer, the inner panel having a concave surface and a convex surface;

(iii) an inner flexible film applied over the convex surface of the inner panel;

(iv) an outer flexible film applied to the inner flexible film such that the inner and outer flexible films are sealed substantially proximal to a periphery of the inner panel forming a cavity between the inner and outer flexible films; and (v) a gel pad positioned in the cavity formed between the inner and outer flexible films, wherein the outer panel is attached only at the outer panel periphery to the first panel by stitching, by welding, or by glue;

(b) a connector extending between an inner region of the two breast cups; and (c) a back strap extending from an outer region of one of the two breast cups to an outer region of the other of the two breast cups to secure the brassiere to a torso of the wearer.

9. A method of manufacturing a breast cup assembly, the method comprising the following steps:

(a) providing an outer panel including an outer fabric layer;

(b) providing an inner panel including an inner fabric layer;

(c) molding the inner panel to a cup form such that the inner panel includes a convex surface on an outer side of the inner panel and a concave surface on an inner side of the inner panel;

(d) applying an inner flexible film over the convex surface of the inner panel;

(e) applying an outer flexible film to the inner flexible film and sealing the inner and outer flexible films proximal to a periphery of the inner panel while maintaining an opening between the inner flexible film and the outer flexible film at a predetermined location;

(f) inserting a gel through the opening between the inner flexible film and the outer flexible film to form a gel pad;

(g) sealing the opening between the inner flexible film and the outer flexible film;

(h) curing the gel so as to maintain the cup form of the inner panel;

(i) attaching the outer panel to the inner panel and gel pad to form the breast cup assembly; and (j) trimming the breast cup assembly to a desired shape.

10. A method of manufacturing a breast cup assembly according to claim 9, wherein the inner flexible film is applied to the convex surface of the inner panel by suction means.

11. A method of manufacturing a breast cup assembly according to claim 10, wherein the step of applying an inner flexible film to the convex surface of the inner panel is preceded by the step of applying an adhesive to the convex surface of the inner panel.

12. A method of manufacturing a breast cup assembly according to claim 10, wherein the inner flexible film is heated prior to application of the inner flexible film to the convex surface of the inner panel by suction means.

13. A method of manufacturing a breast cup assembly according to claim 9, wherein the outer flexible film is formed into a cup shape prior to its application to the inner flexible film.

14. A method of manufacturing a breast cup assembly according to claim 13, wherein the outer flexible film is preformed into a cup shape by suction means.

15. A method of manufacturing a breast cup assembly according to claim 14, wherein the outer flexible film is heated prior to preforming into a cup shape by suction means.

16. A method of manufacturing a breast cup assembly according to claim 9, wherein the step of sealing the inner and outer flexible films proximal to a periphery of the inner panel includes sealing by high frequency welding.

17. A method of manufacturing a breast cup assembly according to claim 9, wherein the step of inserting a gel through the opening between the inner flexible film and the outer flexible film to form a gel pad includes injecting the gel through the opening.

18. A method of manufacturing a breast cup assembly according to claim 9, wherein the step of inserting a gel through the opening between the inner flexible film and the outer flexible film to form a gel pad includes pouring the gel through the opening.

19. A method of manufacturing a breast cup assembly according to claim 9, wherein the step of curing the gel to maintain the cup form of the inner panel includes placing the inner panel and gel pad between opposing molds and applying heat thereto.

20. A method of manufacturing a breast cup assembly, the method comprising the following steps:

(a) providing an inner panel including an inner fabric layer;

(b) providing an outer panel including an outer fabric layer;

(c) molding the outer panel to a cup form such that the outer panel includes a concave surface on the inner side of the outer panel and a convex surface on the outer side of the outer panel;

(d) applying an outer flexible film to the concave surface of the outer panel;

(e) applying an inner flexible film to the outer flexible film and sealing the inner and outer flexible films proximal to a periphery of the outer panel while maintaining an opening between the inner flexible film and the outer flexible film at a predetermined location;

(f) inserting a gel through the opening between the inner flexible film and the outer flexible film to form a gel pad;

(g) sealing the opening between the inner flexible film and the outer flexible film;

(h) curing the gel so as to maintain the cup form of the outer panel;

(i) attaching the inner panel to the outer panel and gel pad to form the breast cup assembly; and (j) trimming the breast cup assembly to the desired shape.

21. A method of manufacturing a breast cup assembly, the method comprising the following steps:

(a) providing a first panel including a fabric layer;

(b) providing a second panel including a fabric layer;

(c) molding the first panel to a cup form such that the first panel includes a concave surface on one side of the first panel and a convex surface on the opposite side of the first panel;

(d) applying a first flexible film over a surface of the first panel, the surface being the one that is going to face the second panel in the breast cup assembly to be formed;

(e) applying a second flexible film to the first flexible film and sealing the first and second flexible films proximal to a periphery of the first panel while maintaining an opening between the first flexible film and the second flexible film at a predetermined location;

(f) inserting a gel through the opening between the first flexible film and the second flexible film to form a gel pad;

(g) sealing the opening between the first flexible film and the second flexible film;

(h) attaching the second panel to the first panel and gel pad to form the breast cup assembly; and (i) trimming the breast cup assembly to the desired shape.

22. A breast cup assembly according to claim 1, wherein the gel pad fills the entire cavity formed between the inner and outer flexible films.

* * * * *